US009653033B2

(12) United States Patent
Kobayashi et al.

(10) Patent No.: US 9,653,033 B2
(45) Date of Patent: May 16, 2017

(54) LIQUID CRYSTAL DISPLAY DEVICE TO MITIGATE DARK CORNERS

(71) Applicant: Japan Display Inc., Tokyo (JP)

(72) Inventors: Masahiro Kobayashi, Tokyo (JP); Masateru Morimoto, Tokyo (JP); Takeshi Sato, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/789,217

(22) Filed: Jul. 1, 2015

(65) Prior Publication Data

US 2016/0005364 A1 Jan. 7, 2016

(30) Foreign Application Priority Data

Jul. 2, 2014 (JP) ..... 2014-136788

(51) Int. Cl.
*G09G 3/36* (2006.01)

(52) U.S. Cl.
CPC ... *G09G 3/3648* (2013.01); *G09G 2300/0413* (2013.01); *G09G 2300/0426* (2013.01); *G09G 2300/0447* (2013.01)

(58) Field of Classification Search
CPC ..... G09G 3/3648; G09G 2300/0413; G09G 2300/0426
See application file for complete search history.

(56) References Cited

U.S. PATENT DOCUMENTS

2008/0074602 A1* 3/2008 Arai ..... G02F 1/134363 349/146
2011/0222009 A1* 9/2011 Itou ..... G02F 1/134363 349/139

FOREIGN PATENT DOCUMENTS

JP H10-333182 A 12/1998

* cited by examiner

*Primary Examiner* — Larry Sternbane
(74) *Attorney, Agent, or Firm* — Typha IP LLC

(57) ABSTRACT

In an IPS mode liquid crystal display device, measures are taken against dark unevenness at the corner portion of a screen. The problem can be solved by a liquid crystal display device in which a comb tooth pixel electrode is formed on a common electrode formed in a flat surface through an interlayer insulating film; a TFT substrate is formed with a dummy pixel region and a display region surrounding the display region; a pixel on the display region is formed with a comb tooth display region pixel electrode bent in a projection in the first direction; and a pixel on the dummy pixel region is formed with a comb tooth dummy pixel region pixel electrode bent in a projection in a direction opposite to the first direction at an angle of 180 degrees.

17 Claims, 18 Drawing Sheets

LIQUID CRYSTAL DISPLAY DEVICE TO MITIGATE DARK CORNERS

CLAIM OF PRIORITY

The present application claims priority from Japanese Patent Application JP 2014-136788 filed on Jul. 2, 2014, the content of which is hereby incorporated by reference into this application.

BACKGROUND OF THE INVENTION (1) Field of the Invention

The present disclosure relates to a display device, and more specifically to a liquid crystal display device in a lateral electric field mode excellent in viewing angle characteristics.

(2) Description of the Related Art

In the liquid crystal display device, a TFT substrate includes a pixel having a pixel electrode, a thin film transistor (a TFT), and the like formed in a matrix configuration, a counter substrate is disposed opposite to the TFT substrate, and a liquid crystal is sandwiched between the TFT substrate and the counter substrate. An image is formed by controlling the optical transmittance of liquid crystal molecules for individual pixels. Since the liquid crystal display device is flat and light-weight, the use is widely spread in various fields. Small-sized liquid crystal display devices are widely used in a mobile telephone, a DSC (Digital Still Camera), and the like.

An alignment film is used to initially orientate liquid crystal molecules. There are methods for aligning this alignment film by a rubbing method and for aligning this alignment film by applying polarized ultraviolet rays to the alignment film. In the rubbing method, the surface of the alignment film is rubbed by a cloth like material. In the rubbing, ionic foreign substances are produced. Moreover, ionic foreign substances are also produced caused by contamination due to manufacturing processes and a manufacture apparatus and caused by degraded members configuring a liquid crystal display device. These foreign substances specifically exist on the peripheral portions to cause unevenness around a screen.

Japanese Unexamined Patent Application Publication No. Hei10 (1999)-333182 describes a configuration in which a pixel pitch on a dummy pixel region in the vertical direction or the lateral direction is different from a pixel pitch on a display region in order to confine ionic foreign substances on the dummy pixel region on the peripheral portion of the display region.

SUMMARY OF THE INVENTION

In the liquid crystal display device, a problem is viewing angle characteristics. The viewing angle characteristics are phenomena that the luminance is changed or the chromaticity is changed between the case where the screen is viewed from the front and the case where the screen is viewed from the oblique direction. As for the viewing angle characteristics, an IPS (In Plane Switching) mode has more excellent characteristics in which liquid crystal molecules are operated with a horizontal electric field.

In order to more uniformize the viewing angle characteristics, such a configuration is used in which a pixel electrode or a common electrode is in a bent shape. FIG. 17 is a plan view of an example of a pixel electrode like this. In FIG. 17, scanning lines 40 are extended in the lateral direction and arrayed in the vertical direction, and picture signal lines 50 are extended in the vertical direction and arrayed in the lateral direction. A region surrounded by the scanning line 40 and the picture signal line 50 is a pixel. In FIG. 17, a pixel electrode 103 is bent in a projection in the right direction.

The pixel electrode shape as in FIG. 17 is called a dual domain mode. In the case where the pixel electrode 103 is in this shape, when a picture signal is applied to the pixel electrode 103, ions in a liquid crystal are moved in the orientation of an arrow illustrated in FIG. 18, and dark unevenness 15 is produced on the upper right corner portion of a display region 10 illustrated in FIG. 18, for example.

FIG. 19 is a dual domain that is formed in units of two pixels in order to uniformize the viewing angle characteristics. This mode is called a pseudo dual domain mode. In FIG. 19, a pixel on the upper side and a pixel on the lower side make a pair, in which a pixel electrode 103 of the pixel on the upper side has a slope tilted to the lower right, and the pixel electrode on the lower side is tilted to the upper right. The long axis of the pixel electrode on the upper side intersects with the long axis of the pixel electrode on the lower side at an angle in a projection in the right direction in FIG. 19. When the pixel electrode 103 is in this shape, dark unevenness 15 is produced on the lower right corner portion of the display region 10 as illustrated in FIG. 20, for example.

FIG. 21 is a schematic cross sectional view illustrative of a phenomenon of the migration of ions described above. In FIG. 21, a liquid crystal 300 is sandwiched between a TFT substrate 100 and a counter substrate 200. A common electrode 101 is formed on the TFT substrate 100 side, and a comb tooth pixel electrode 103 is formed through an interlayer insulating film 102. In FIG. 21, layers on the lower side of the common electrode 101 are omitted. Moreover, a black matrix, an overcoat, and the like formed on the counter substrate 200 are omitted. The orientation of the motion of an ion 110 in FIG. 21 is the direction opposite to the directions of the motion of ions illustrated in FIGS. 18 and 20. In other words, in FIG. 21, it is assumed that the bending direction of the pixel electrode is directed to the left side in FIG. 21. The left side in FIG. 21 is the end portion of the display region.

In FIG. 21, when a picture signal is applied across the pixel electrode 103 and the common electrode 101, the ion 110 in the liquid crystal 300 is moved in the direction of an arrow, and is accumulated on the peripheral portion of a screen. With this accumulation, an electric field across the pixel electrode 103 and the common electrode 101 is disturbed on the peripheral portion of the display region because of the influence of the ion 110, leading to the cause of the production of dark unevenness.

It is an object of the present disclosure to prevent the production of dark unevenness in an IPS mode liquid crystal display device.

The present disclosure is to overcome the problems, and the following is specific schemes.

(1) A liquid crystal display device including: a TFT substrate including a scanning line extended in a first direction and arrayed in a second direction at a right angle to the first direction, a picture signal line extended in the second direction and arrayed in the first direction, and a pixel formed between the scanning line and the picture signal line; a counter substrate; and a liquid crystal sandwiched between the TFT substrate and the counter substrate. In the liquid crystal display device, the pixel is formed with a comb tooth pixel electrode on a common electrode formed in a flat surface through an interlayer insulating film; a display region and a dummy pixel region surrounding the display region are formed on the TFT substrate; a comb tooth display region pixel electrode is formed on a pixel on the display region; the comb tooth display region pixel electrode is bent in a projection in the first direction; a comb tooth dummy pixel region pixel electrode is formed on a pixel on the dummy pixel region; and the comb tooth dummy pixel region pixel electrode is bent in a projection in a direction opposite to the first direction at an angle of 180 degrees.

(2) In the liquid crystal display device according to (1), a TFT connected to the comb tooth display region pixel electrode is disposed in the second direction with respect to the comb tooth display region pixel electrode; and a TFT connected to the comb tooth dummy pixel region pixel electrode is disposed in a direction opposite to the second direction at an angle of 180 degrees with respect to the comb tooth dummy pixel region pixel electrode.

(3) A liquid crystal display device including: a TFT substrate including a scanning line extended in a first direction and arrayed in a second direction at a right angle to the first direction, a picture signal line extended in the second direction and arrayed in the first direction, and a pixel formed between the scanning line and the picture signal line; a counter substrate; and a liquid crystal sandwiched between the TFT substrate and the counter substrate. In the liquid crystal display device, the pixel is formed with a comb tooth pixel electrode on a common electrode formed in a flat surface through an interlayer insulating film; a display region and a dummy pixel region surrounding the display region are formed on the TFT substrate; a first display region pixel having a first comb tooth pixel electrode and a second display region pixel having a second comb tooth pixel electrode are formed in the second direction in a pair on the display region; a first dummy pixel region pixel having a third comb tooth pixel electrode and a second dummy pixel region pixel having a fourth comb tooth pixel electrode are formed in the second direction in a pair on the dummy pixel region; the first display region pixel and the first dummy pixel region pixel are disposed adjacent to each other in the first direction; the second display region pixel and the second dummy pixel region pixel are disposed adjacent to each other in the first direction; a long axis direction of the first comb tooth pixel electrode intersects with a long axis direction of the second comb tooth pixel electrode at an angle in a projection in the first direction; and a long axis direction of the third comb tooth pixel electrode intersects with a long axis direction of the fourth comb tooth pixel electrode at an angle in a projection in a direction opposite to in the first direction at an angle of 180 degrees.

(4) In the liquid crystal display device according to (3), on the display region, a TFT connected to the first pixel electrode is disposed in the second direction with respect to the first pixel electrode, and a TFT connected to the second pixel electrode is disposed in the second direction with respect to the second pixel electrode; and on the dummy pixel region, a TFT connected to the third pixel electrode is disposed in a direction opposite to the second direction at an angle of 180 degrees with respect to the third pixel electrode, and a TFT connected to the fourth pixel electrode is disposed in a direction opposite to the second direction at an angle of 180 degrees with respect to the fourth pixel electrode.

(5) A liquid crystal display device including: a TFT substrate including a scanning line extended in a first direction and arrayed in a second direction at a right angle to the first direction, a picture signal line extended in the second direction and arrayed in the first direction, and a pixel formed between the scanning line and the picture signal line; a counter substrate; and a liquid crystal sandwiched between the TFT substrate and the counter substrate. In the liquid crystal display device, the pixel is formed with a common electrode on a pixel electrode formed in a flat surface through an interlayer insulating film; a display region and a dummy pixel region surrounding the display region are formed on the TFT substrate; in a pixel on the display region, a display region slit is formed on the common electrode; the display region slit is bent in a projection in the first direction; in a pixel on the dummy pixel region, a dummy pixel region slit is formed on the common electrode; and the dummy pixel region slit is bent in a projection in a direction opposite to the first direction at an angle of 180 degrees.

(6) In the liquid crystal display device according to (5), a TFT connected to the pixel electrode on the display region is disposed in the second direction with respect to the pixel electrode on the display region; and a TFT connected to the pixel on the dummy pixel region electrode is disposed in a direction opposite to the second direction at an angle of 180 degrees with respect to the pixel electrode on the dummy pixel region.

(7) A liquid crystal display device including: a TFT substrate including a scanning line extended in a first direction and arrayed in a second direction at a right angle to the first direction, a picture signal line extended in the second direction and arrayed in the first direction, and a pixel formed between the scanning line and the picture signal line; a counter substrate; and a liquid crystal sandwiched between the TFT substrate and the counter substrate. In the liquid crystal display device, the pixel is formed with a common electrode on a pixel electrode formed in a flat surface through an interlayer insulating film; a display region and a dummy pixel region surrounding the display region are formed on the TFT substrate; a first display region pixel having a first slit and a second display region pixel having a second slit are formed in the second direction in a pair on the display region; a first dummy pixel region pixel having a third slit and a second dummy pixel region pixel having a fourth slit are formed in the second direction in a pair on the dummy pixel region; the first display region pixel and the first dummy pixel region pixel are disposed adjacent to each other in the first direction; the second display region pixel and the second dummy pixel region pixel are disposed adjacent to each other in the first direction; a long axis direction of the first slit intersects with a long axis direction of the second slit at an angle in a projection in the first direction; and a long axis direction of the third slit intersects with a long axis direction of the fourth slit at an angle in a projection in a direction opposite to in the first direction at an angle of 180 degrees.

(8) In the liquid crystal display device according to (7), on the display region, a TFT connected to the pixel electrode is disposed in the second direction with respect to the pixel electrode; and on the dummy pixel region, a TFT connected to the pixel electrode is disposed in a direction opposite to the second direction at an angle of 180 degrees with respect to the pixel electrode.

(9) In the liquid crystal display device according to (1) to (8), a polarity of a picture signal applied to a pixel column on the display region adjacent to the dummy pixel region is opposite to a polarity of a picture signal applied to a pixel column on the dummy pixel region adjacent to the display region.

(10) In the liquid crystal display device according to (9), an absolute value of the picture signal applied to the pixel column on the dummy pixel region adjacent to the display region is the same as or greater than an absolute value of the picture signal applied to the pixel column on the display region adjacent to the dummy pixel region.

DETAILED DESCRIPTION OF THE PREFERRED EMBODIMENTS

In the following, the content of the present disclosure will be described in detail with reference to embodiments.

First Embodiment

Figure 1:
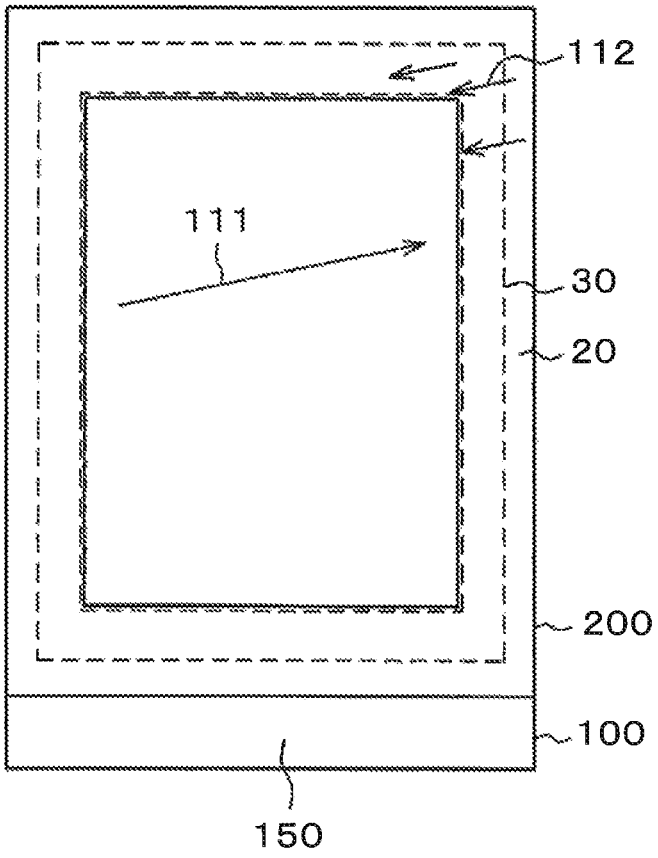
FIG. 1 is a plan view of a liquid crystal display device to which the present disclosure is applied.

FIG. 1 is a plan view of a liquid crystal display device to which the present disclosure is applied. This liquid crystal display device is used for a mobile telephone, for example. In FIG. 1, a TFT substrate 100 on which a pixel electrode, a TFT, and the like are formed is attached to a counter substrate 200 on which a black matrix and the like are formed through a sealing material formed on the peripheral portion, and a liquid crystal is encapsulated on the inner sides of the substrates. The TFT substrate 100 is formed greater than the counter substrate 200, and on a portion where only the TFT substrate 100 is provided, a terminal portion 150 is formed on which a driver IC is mounted and a flexible circuit board and the like are connected.

A picture frame region 20 is formed to surround a display region 10. The picture frame region 20 is covered with the black matrix formed on the counter substrate 200. On the picture frame region 20, a dummy pixel region 30, a lead line to guide a wire to a terminal portion, and other components are formed to surround the display region 10. A pixel on the dummy pixel region 30 is formed adjacently to a pixel on the display region 10. Moreover, on the outermost portion of the picture frame region 20, the sealing material is formed to attach the TFT substrate 100 to the counter substrate 200.

In FIG. 1, an arrow 111 on the display region 10 expresses the moving direction of ions on the display region. Furthermore, an arrow 112 expresses the moving direction of ions on the dummy pixel region. The feature of the present disclosure is in that as described later, the shapes of pixel electrodes are varied between the display region 10 and the dummy pixel region 30, the moving direction of ions is set in the opposite directions between the display region and the dummy pixel region, and such a phenomenon is prevented that ions are accumulated on the peripheral portion of the display region 10 to produce dark unevenness.

Figure 2:
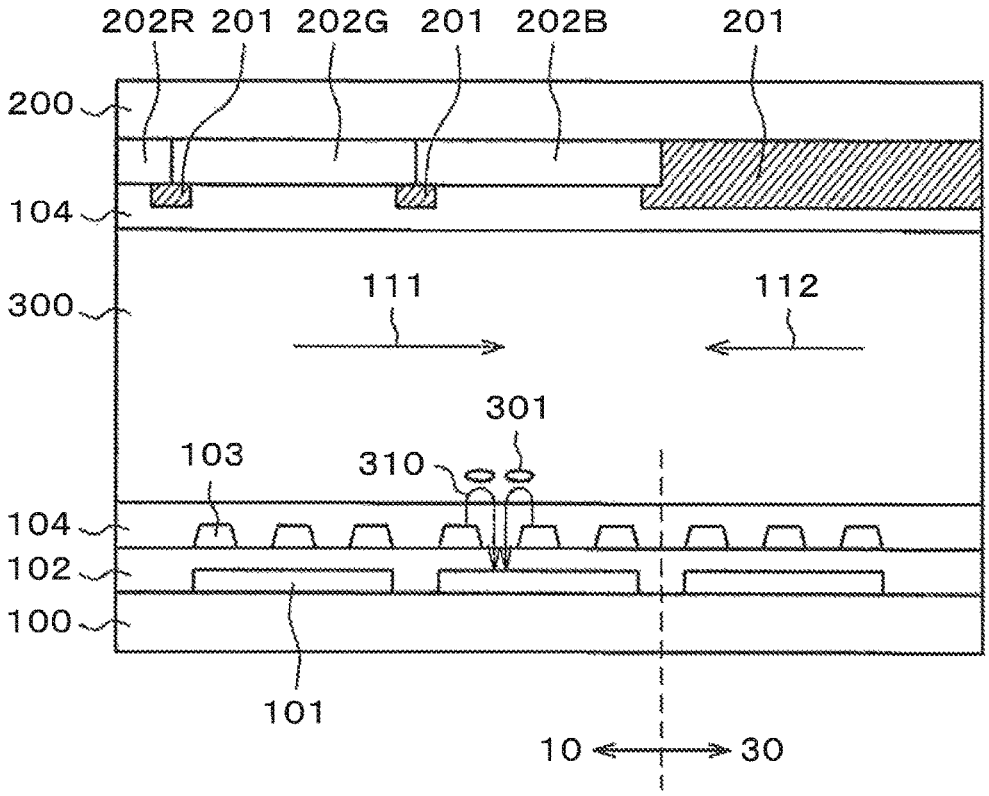
FIG. 2 is a cross sectional view of the effect of the present disclosure.

FIG. 2 is a schematic diagram of a cross section of the right end portion of the display region in FIG. 1. In FIG. 2, a liquid crystal 300 is sandwiched between the TFT substrate 100 and the counter substrate 200. In an actual product, the TFT substrate 100 is formed with a semiconductor layer, a gate insulating film, a gate electrode, an interlayer insulating film, a drain electrode, a source electrode, an inorganic passivation film or an organic passivation film, and the like, and these layers are omitted in FIG. 2. Therefore, in FIG. 2, the diagram is illustrated as through the TFT substrate 100 is directly formed on a common electrode 101. In FIG. 2, an interlayer insulating film 102 is formed to cover the common electrode 101, and a comb tooth pixel electrode 103 is formed on the interlayer insulating film 102. An alignment film 104 is then formed to cover the pixel electrode 103.

The counter substrate 200 is formed with a black matrix 201, a color filter 202 including a red color filter 202R, a green color filter 202G, and a blue color filter 202B, and an alignment film 104 that covers these filters. Typically, although an overcoat is formed to cover the color filter 202 in order to prevent a chemical reaction between the liquid crystal 300 and the color filter 202 or to planarize irregularities on the color filter 202, the overcoat is omitted in FIG. 2. It is noted that in FIG. 2, although the black matrix 201 is formed on the color filter 202, it may be fine that the black matrix 201 is formed before the color filter 202 is formed.

In FIG. 2, when a voltage is applied across the common electrode 101 and the pixel electrode 103 of the TFT substrate 100, an electric line of force as depicted by 310 is produced to rotate liquid crystal molecules 301, the transmittance of the liquid crystal in the pixels is controlled, and an image is formed. In FIG. 2, the common electrode 101 is independent for the individual pixels. However, actually, the same common voltage is applied to the common electrode 101 in the pixels. Therefore, the common electrode can also be formed in a flat surface in common in the pixels.

Figure 3:
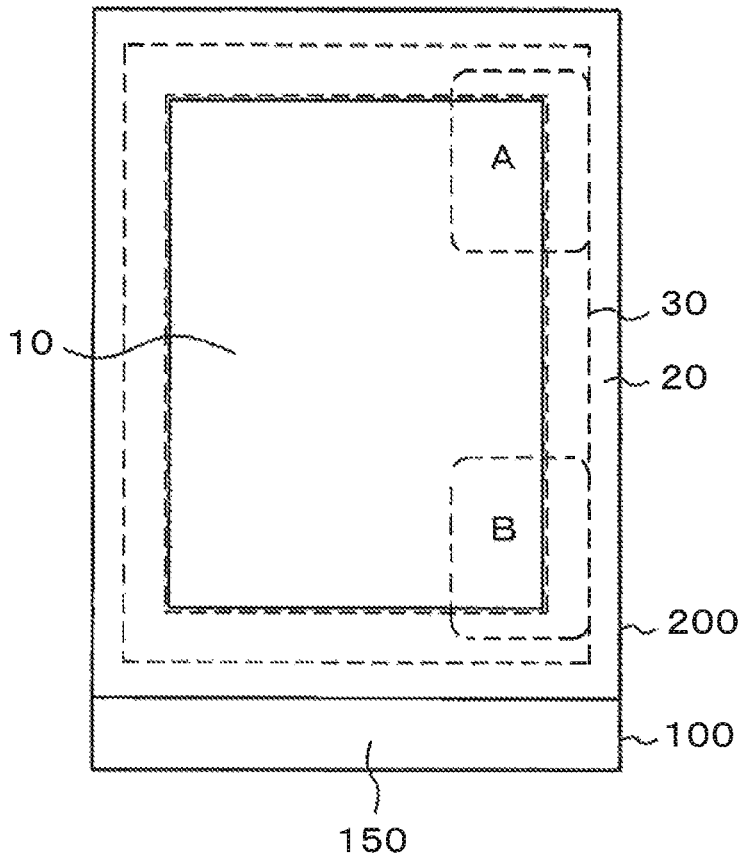
FIG. 3 is a plan view of a liquid crystal display device to which the present disclosure is applied.
Figure 4:
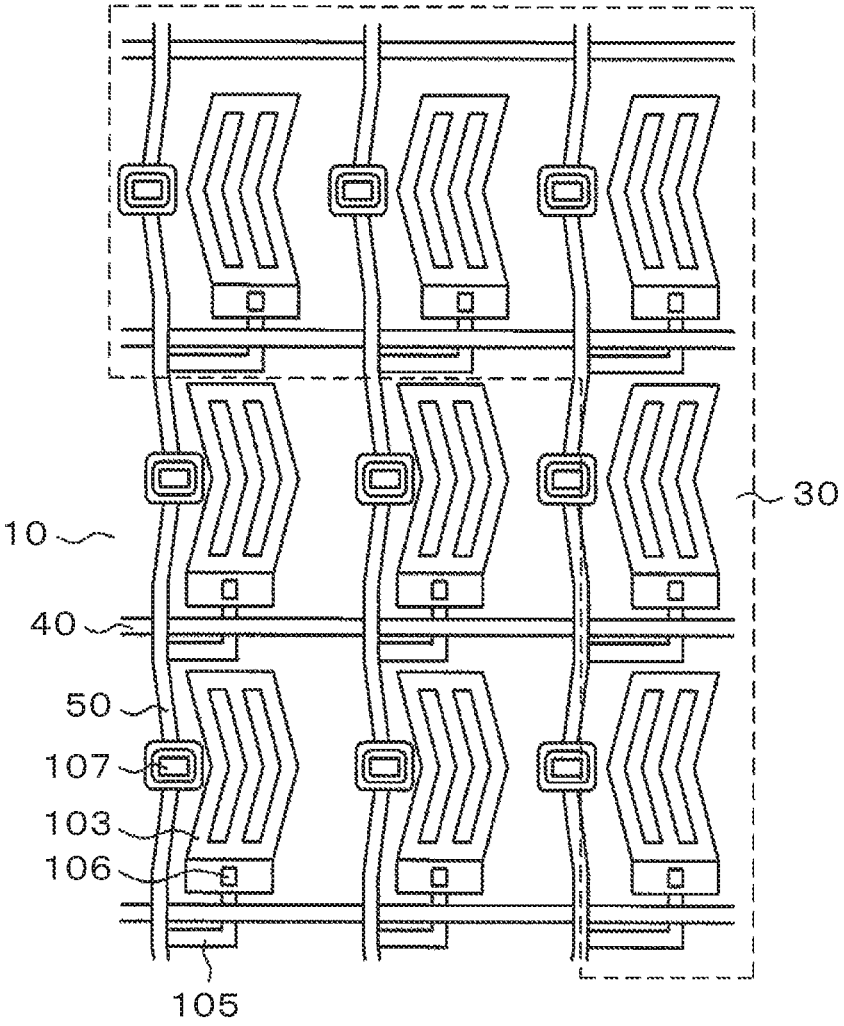
FIG. 4 is a plan view of the shape of a pixel in a region A in FIG. 3.
Figure 5:
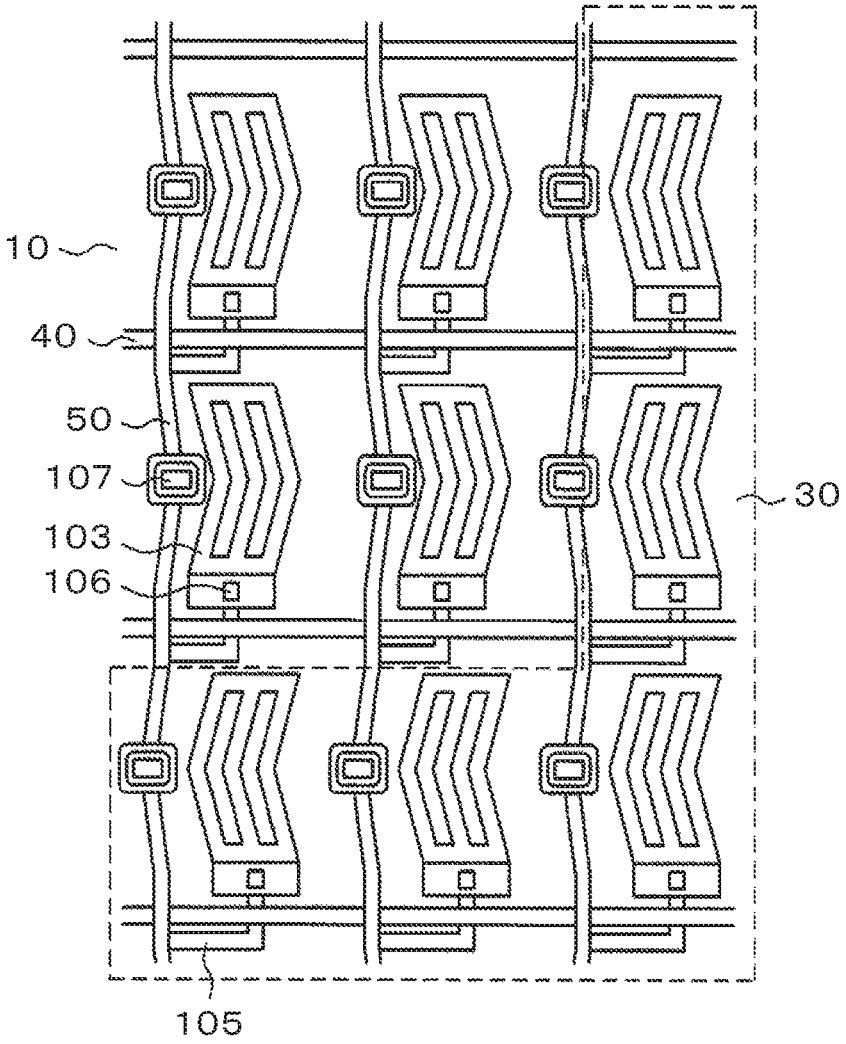
FIG. 5 is a plan view of the shape of a pixel in a region B in FIG. 3.

FIGS. 4 and 5 are the plane forms of the pixel electrodes 103 according to the embodiment. FIG. 4 is a plan view of a region A in FIG. 3, and FIG. 5 is a plan view of a region B in FIG. 3. In FIGS. 4 and 5, 105 is a semiconductor layer, 106 is a contact hole connecting the semiconductor layer 105 and the pixel electrode 103, 107 is a contact hole connecting the semiconductor layer 105 and the picture signal line 50. As illustrated in FIG. 4, when the shape of the pixel electrode 103 on the display region 10 is in a shape bent in a projection on the right side, as illustrated in FIG. 2, the orientation of a flow of ions on the display region 10 is the right direction as expressed by an arrow 111. On the other hand, as illustrated in FIG. 4, when the shape of the pixel electrode 103 on the dummy pixel region 30 is in a shape bent in a projection in the left direction, a flow of the ions 110 on the dummy pixel region 30 is the left direction as expressed by an arrow 112 in FIG. 2.

As described above, a flow of ions in the liquid crystal 300 in the present disclosure is in the opposite directions between the display region 10 and the dummy pixel region 30 surrounding the display region. In other words, a flow of ions on the dummy pixel region 30 is directed in the orientation that a flow of ions on the display region 10 is stopped, so that the accumulation of ions on the peripheral portion of the display region 10 can be prevented.

FIG. 5 is a plan view of the shape of the pixel electrode 103 on the display region 10 and the shape of the pixel electrode 103 on the dummy pixel region 30 on the region B in FIG. 3. Also for the region in FIG. 5, the effect of the present disclosure described as FIG. 4 is taken as an example is the same. Moreover, the similar effect can also be exerted on the upper end portion of the display region 10 in FIG. 4 and on the lower end portion of the display region 10*d* in FIG. 5 as well as on the right end portion of the display region 10 in FIGS. 4 and 5.

Figure 6:
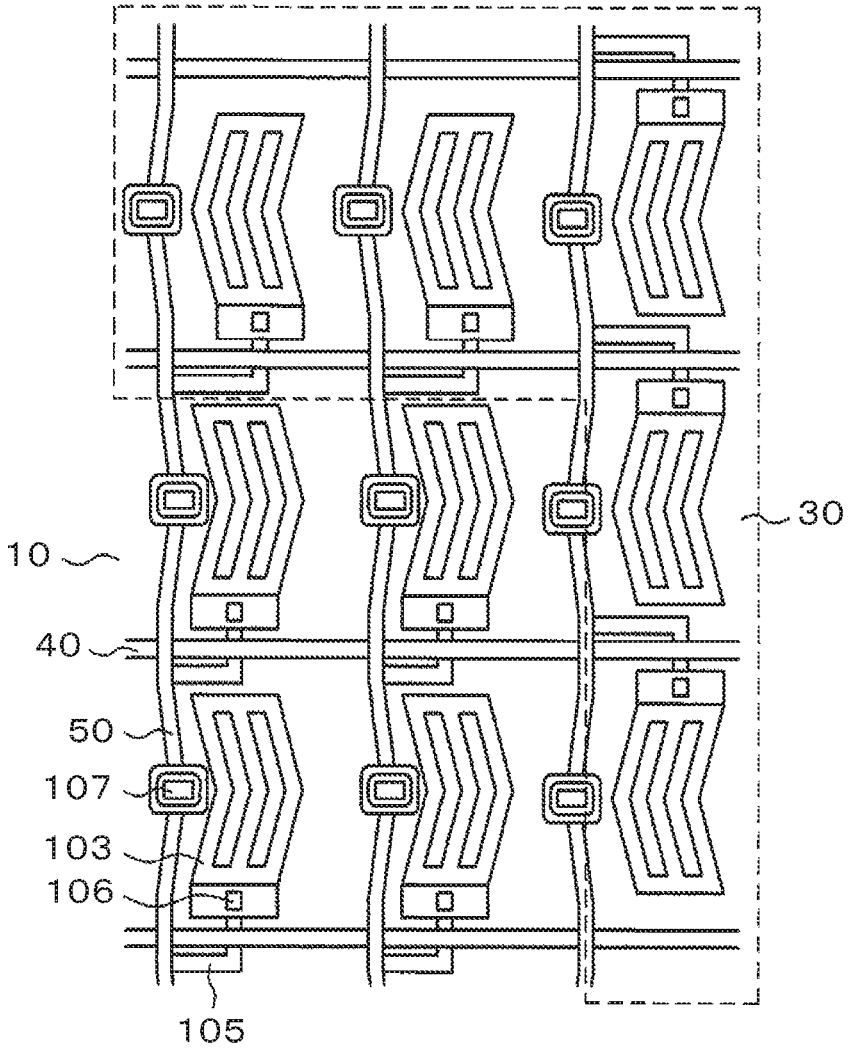
FIG. 6 is a plan view of another shape of a pixel in the region A in FIG. 3.
Figure 7:
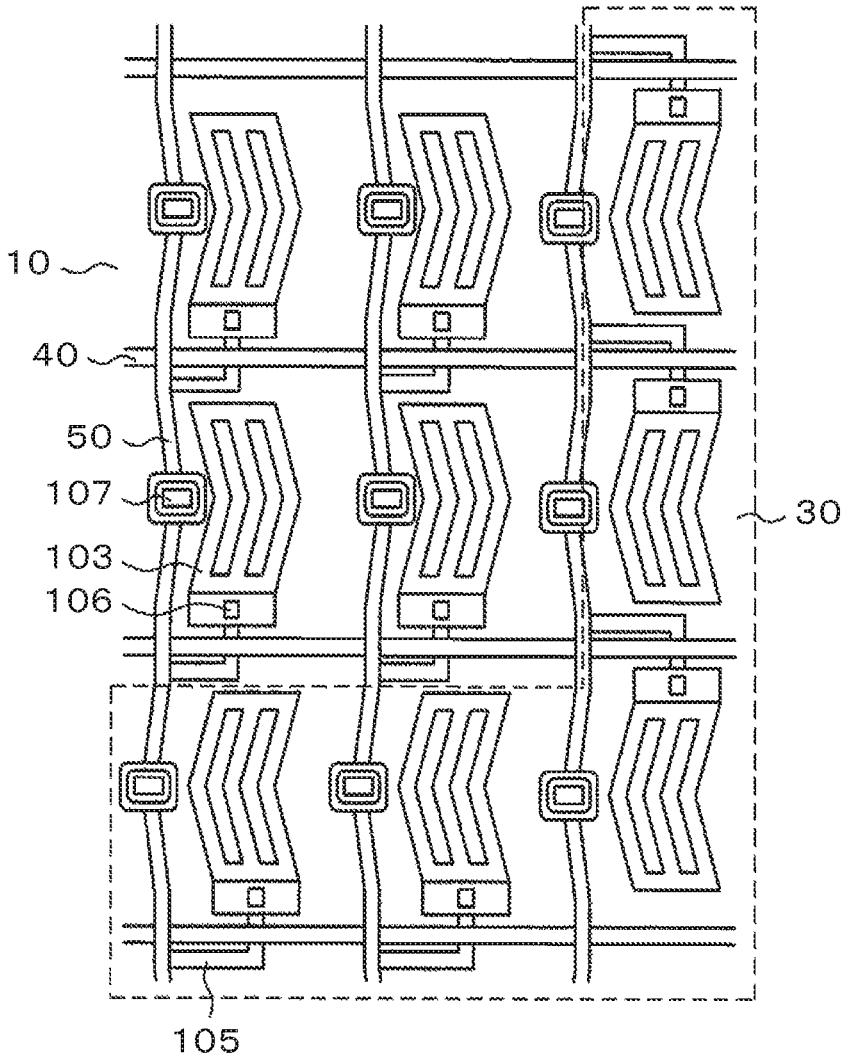
FIG. 7 is a plan view of another shape of a pixel in the region B in FIG. 3.

FIGS. 4 and 5 are the configurations in which only the pixel electrode 103 on the dummy pixel region 30 is made different from the pixel electrode 103 on the display region 10. On the other hand, FIGS. 6 and 7 are configurations in which on the dummy pixel region 30, the pixel electrode 103 is different as well as the position of the TFT to switch a picture signal applied to the pixel electrode 103 is different from the display region 10. FIG. 6 is a plan view of pixels on the display region 10 and the dummy pixel region 30 on the region A in FIG. 3, and FIG. 7 is a plan view of pixels on the display region 10 and the dummy pixel region 30 on the region B in FIG. 3.

In FIG. 6, attention is paid for the second pixel row from above. In the pixels on the display region 10, the TFT is switched using a scanning line 40 that also serves as a gate electrode on the lower side. On the other hand, in the pixels on the dummy pixel region 30 adjacent to the pixels on the end portion of the display region 10, the TFT is switched using the scanning line 40 that also serves as a gate electrode on the upper side. This is similarly applied to the second pixel row from below in FIG. 7.

As described above, in FIGS. 6 and 7, the bending direction of the pixel electrode 103 on the dummy pixel region is set opposite to the bending direction of the pixel electrode on the display region as well as the position of the TFT is also at the opposite positions between the display region 10 and the dummy pixel region 30, so that the effect of stopping the accumulation of ions on the peripheral portion of the display region 10 can be improved more than in the forms in FIGS. 4 and 5. It is noted that in FIGS. 6 and 7, the positions of the TFTs in the pixels adjacent to the scanning line 40 in the vertical direction, that is, the pixels on the dummy pixel region 30 on the upper side of the display region 10 in FIG. 6, or the pixels on the dummy pixel region 30 on the lower side of the display region 10 in FIG. 7 are at the same positions as the positions of the TFTs in the pixels on the display region.

Second Embodiment

Figure 8:
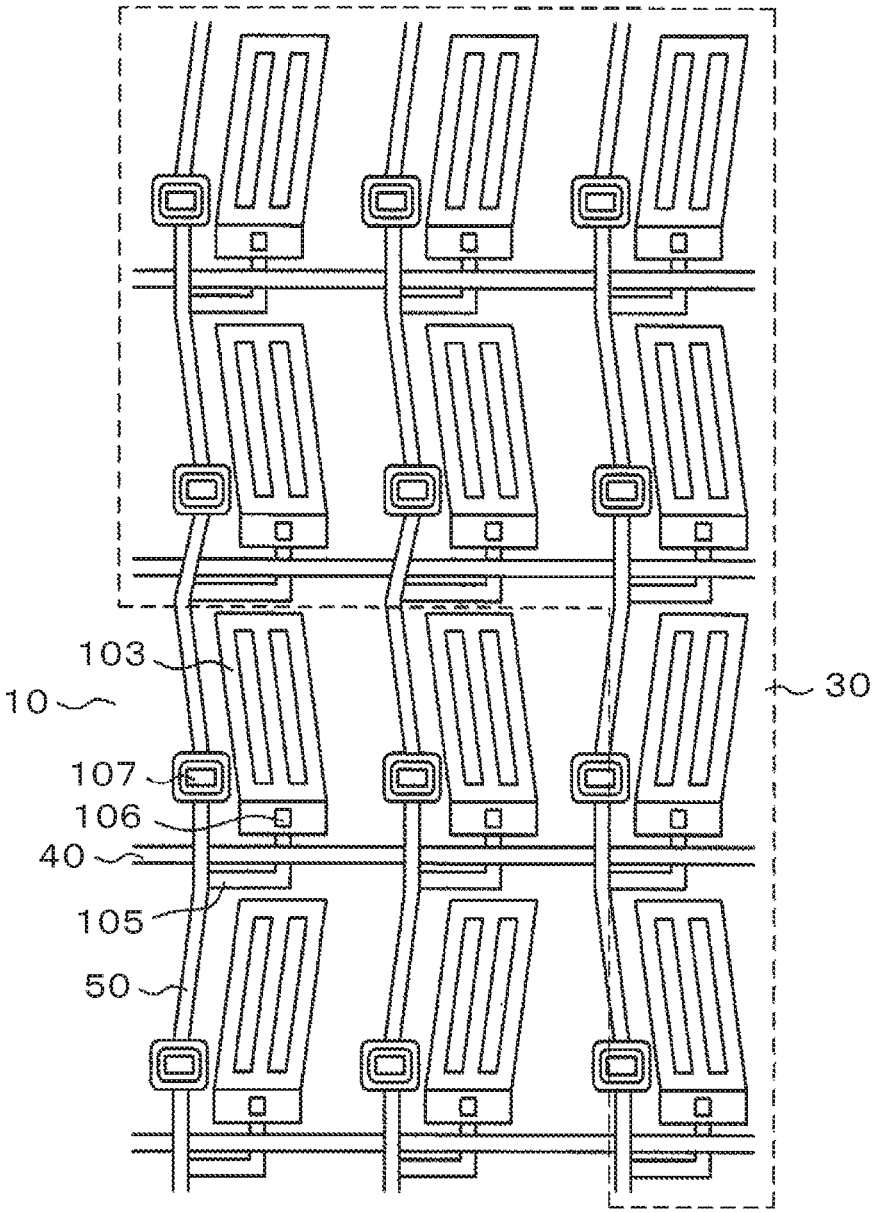
FIG. 8 is a plan view of the shape of a pixel in the region A in FIG. 3 according to a second embodiment.

A second embodiment is an example in which the present disclosure is applied to a liquid crystal display device in a pseudo dual domain mode. FIG. 8 is a plan view of pixels corresponding to the pixels on the region A in FIG. 3. Since the mode in the embodiment is the pseudo dual domain mode, two pixels adjacent in the vertical direction are paired to uniformize the viewing angle characteristics. In FIG. 8, attention is paid for the third and fourth pixel rows. On the display region 10, the long axis of the pixel electrode 103 on the third pixel row is in a shape tilted to the lower right, whereas the long axis of the pixel electrode 103 on the fourth pixel row is in a shape tilted to the upper right. As described above, the slopes of the long axes of the pixel electrodes 103 are in symmetry in the upper part and the lower part of the pixel pair, so that the viewing angle characteristics can be uniformized.

On the dummy pixel region 30 in FIG. 8, the long axis of the pixel electrode 103 on the third pixel row is in a shape tilted to the upper right, and the long axis of the pixel electrode 103 on the fourth pixel row is in a shape tilted to the lower right. In other words, on the same pixel row, the angles of the slopes of the long axes of the pixel electrodes 103 are in the opposite directions between the display region 10 and the dummy pixel region 30. In other words, on the display region 10 in FIG. 8, an angle formed of the long axis direction of the pixel electrode 103 on the third pixel row and the long axis direction of the pixel electrode 103 on the fourth pixel row is in a projection in the right direction in FIG. 8. On the other hand, on the dummy pixel region 30, an angle formed of the long axis direction of the pixel electrode 103 on the third pixel row and the long axis direction of the pixel electrode 103 on the fourth pixel row is in a projection in the left direction in FIG. 8.

The first pixel row and the second pixel row in FIG. 8 are on the dummy pixel region 30. In the region, an angle formed of the long axis of the pixel on the first pixel row and the long axis of the pixel on the second pixel row is in a projection in the left direction. In other words, this angle is the same as an angle formed of the third pixel row on the dummy pixel region 30 and the long axis of the pixel electrode 103 on the fourth pixel row.

Figure 9:
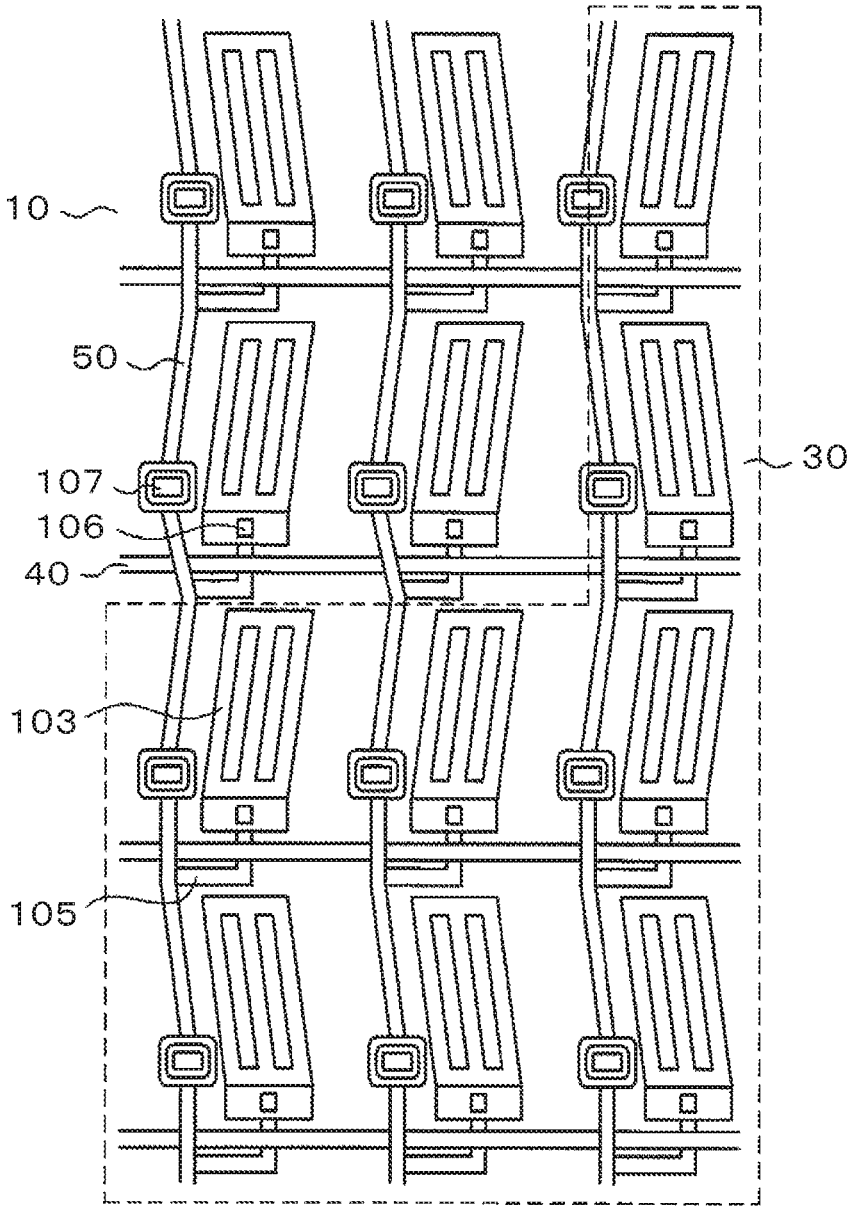
FIG. 9 is a plan view of the shape of a pixel in the region B in FIG. 3 according to the second embodiment.

FIG. 9 is a plan view of pixels corresponding to the region B in FIG. 3. In FIG. 9, an angle formed of the long axis of the pixel electrode 103 on the first pixel row and the long axis of the pixel electrode 103 on the second pixel row on the display region 10 is the same as an angle formed of the long axis of the pixel electrode 103 on the third pixel row and the long axis of the pixel electrode 103 on the fourth pixel row on the display region 10 in FIG. 8. Moreover, on the dummy pixel region in FIG. 9, an angle formed of the long axis of the pixel electrode 103 on the first pixel row and the long axis of the pixel electrode 13 on the second pixel row is also the same as an angle formed of the long axis of the pixel electrode 103 on the third pixel row and the long axis of the pixel electrode 103 on the fourth pixel row in FIG. 9.

As described above, in FIG. 8 and FIG. 9, an angle formed of the long axes of the pixel electrodes 103 of the pixel pair adjacent in the direction at a right angle to the extending direction of the scanning line on the display region 10 is in a shape projecting on the right side, and an angle formed of the long axes of the pixel electrodes 103 of the pixel pair adjacent in the direction at a right angle to the extending direction of the scanning line on the dummy pixel region 30 is in a shape projecting on the left side. Thus, the moving direction of ions on the display region 10 and the moving direction of ions on the dummy pixel region 30 are in the opposite directions, so that it is possible to suppress a phenomenon that ions are accumulated on the end portion of the display region.

Figure 10:
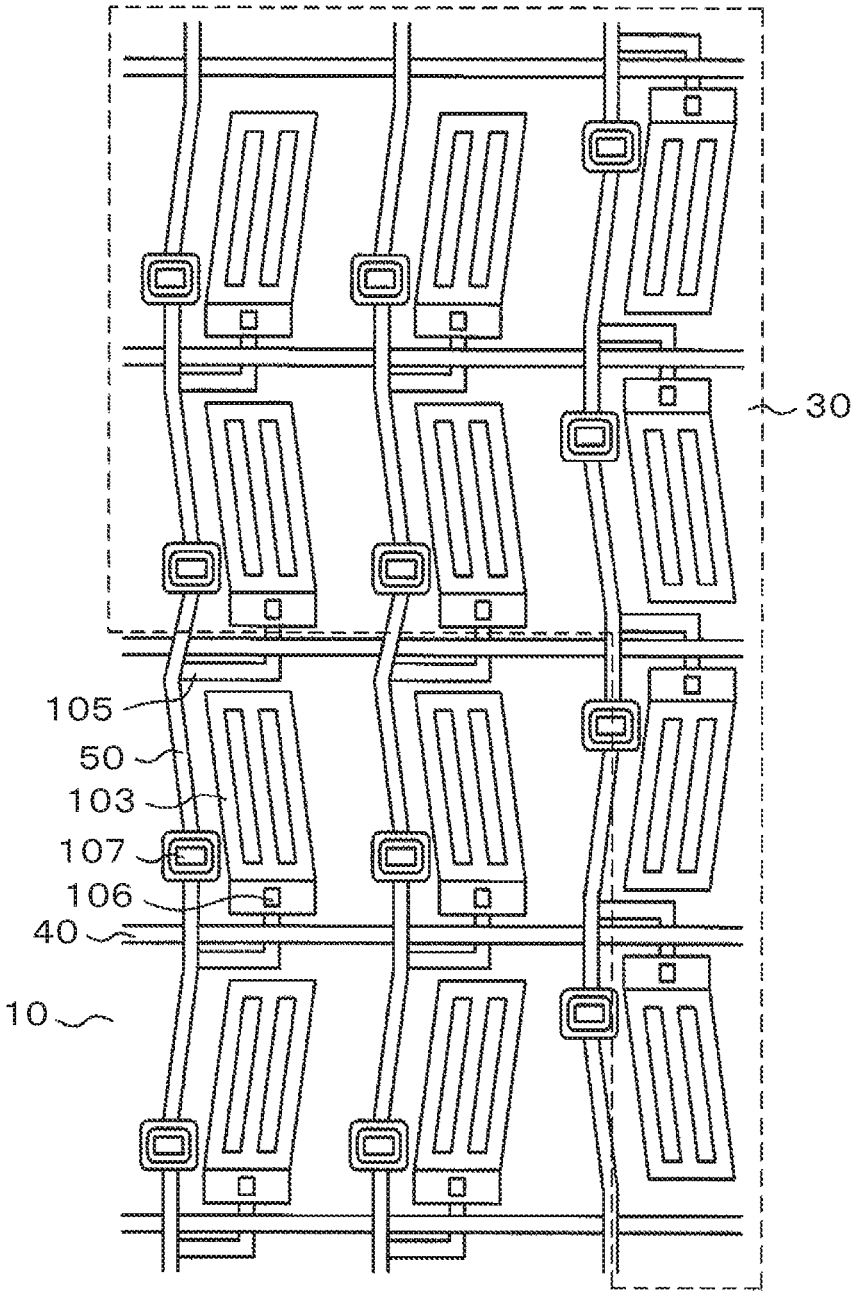
FIG. 10 is a plan view of another shape of a pixel in the region A in FIG. 3 according to the second embodiment.
Figure 11:
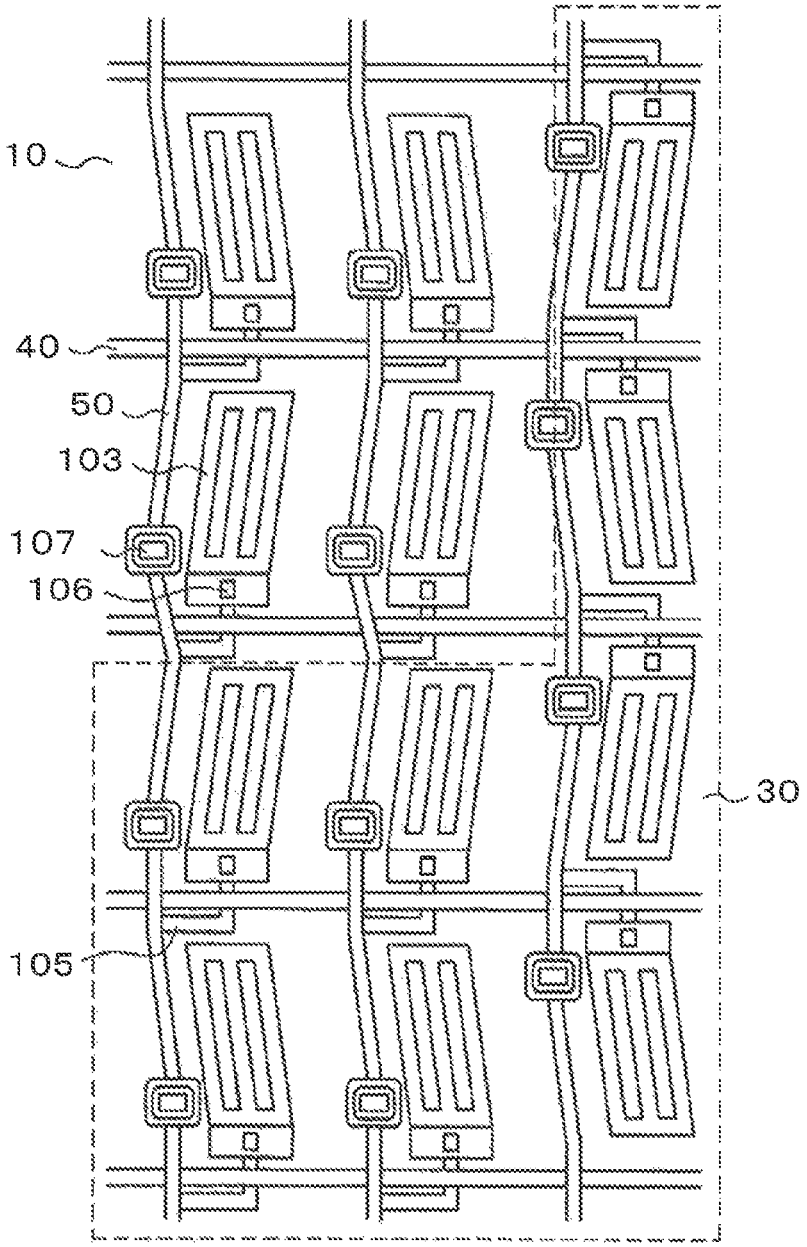
FIG. 11 is a plan view of another shape of a pixel in the region B in FIG. 3 according to the second embodiment.

FIGS. 10 and 11 are plans view of the disposition of pixels in another form according to the second embodiment. FIG. 10 is a plan view corresponding to the region A in FIG. 3. In FIG. 10, in the pixels on the dummy pixel region 30 adjacent to the display region 10 in the extending direction of the scanning line 40, the position of the TFT that controls the supply of a picture signal to the pixel electrode 103 is in the opposite direction. In other words, the position of the TFT is disposed on the lower side in FIG. 10 in the pixels on the display region with respect to the pixel electrode, whereas in the pixels on the dummy pixel region, the position of the TFT is disposed on the upper side in FIG. 10 with respect to the pixel electrode. FIG. 11 is a plan view corresponding to the region B in FIG. 3. The relationship of the structure between the pixels on the display region and the pixels on the dummy pixel region is similar to the description in FIG. 10.

Thus, the effect that the moving direction of ions on the display region and the moving direction of ions on the dummy pixel region are opposite to each other can be more effectively performed than in the cases of FIG. 8 and FIG. 9. It is noted that in FIGS. 10 and 11, on the dummy pixel region, the position of the TFT in the pixel pair adjacent in the direction of the scanning line at a right angle is the same as on the display region. It is noted that in the first embodiment and the second embodiment, the bending direction of the picture signal line on the dummy pixel region is different from the bending direction of the picture signal line on the display region as matched with the bending direction of the dummy pixel electrode. However, it may be fine that the bending direction of the picture signal line of the dummy pixel adjacent in the direction of the gate line is the same as the bending direction on the display region.

Third Embodiment

Figure 12:
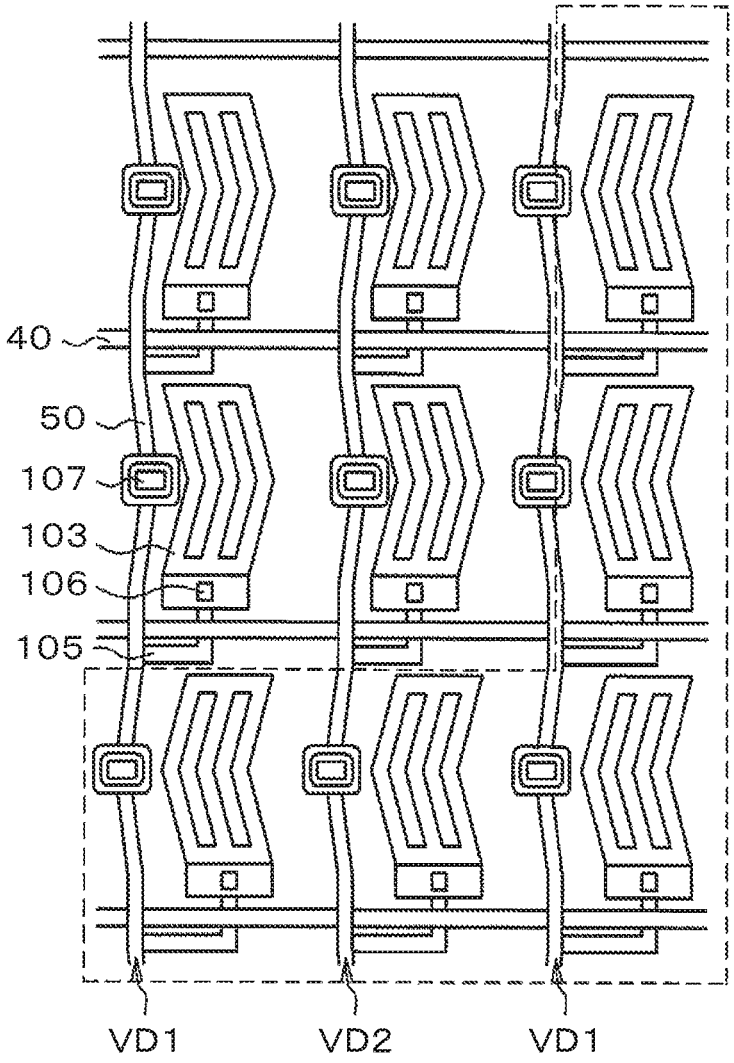
FIG. 12 is a plan view of a configuration according to a third embodiment.

A third embodiment provides a configuration in which in addition to the pixel arrays according to the first embodiment and the second embodiment, a driving method is devised to further improve the effect of the present disclosure. FIG. 12 is a pixel electrode array according to the embodiment and an application method for a picture signal. The pixel array in FIG. 12 is similar to FIG. 5 in the first embodiment. It is effective in the present disclosure that column inversion operation is performed. In FIG. 12, in pixel columns in the vertical direction, a positive picture signal VD1 is applied to the pixel column on the leftmost side, a negative picture signal VD2 is applied to the pixel column on the boundary of the dummy pixel region, and a positive picture signal VD1 is applied to the pixel column on the end portion of the dummy pixel region.

Figure 13:
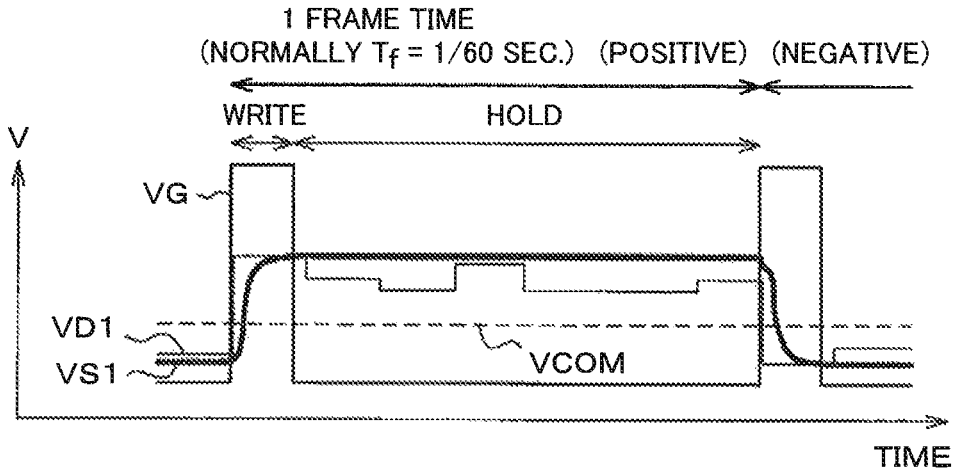
FIG. 13 is a diagram of the potentials of electrodes in the case where a picture signal is positive.

FIG. 13 is an application waveform to the electrodes of the pixels in the pixel column adjacent to the display region 10 in the extending direction of the scanning line on the dummy pixel region 30 in FIG. 12. In FIG. 13, a voltage VG is applied to the gate electrode to turn on the TFT. After the turning on, the picture signal VD1 is written to the pixel electrode, and the potential of the pixel electrode, VS1, is increased. A common voltage VCOM is applied to the opposite common electrode.

Figure 14:
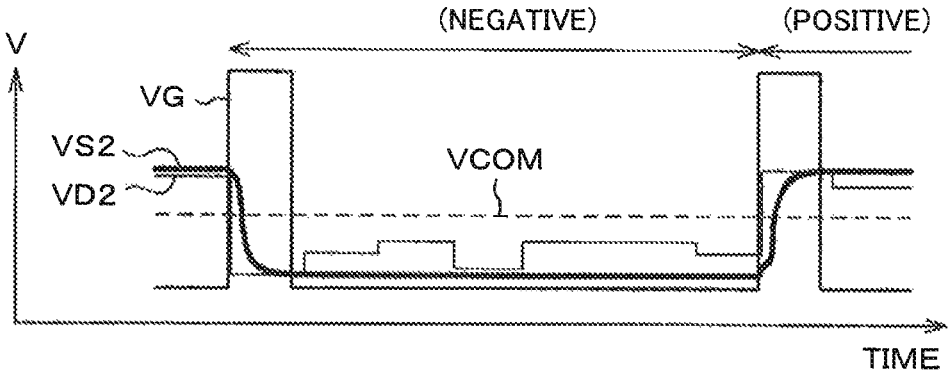
FIG. 14 is a diagram of the potentials of electrodes in the case where a picture signal is negative.

FIG. 14 is an application waveform to the electrodes of the pixels in the pixel column adjacent to the dummy pixel region 30 in the direction of the scanning line on the display region 10 in FIG. 12. In FIG. 14, a voltage VG is applied to the gate electrode to turn on the TFT. After the turning on, the picture signal VD2 is written to the pixel electrode, and the potential of the pixel electrode, VS2, is decreased. In other words, VD2 is a voltage lower than VOM. Since the operation is common inversion in the embodiment, the sign of the picture signal applied to the pixel electrode is different between the adjacent pixel columns.

In the embodiment, the bending direction of the pixel electrode of the pixel column on the dummy pixel region 30 side and the bending direction of the pixel electrode of the pixel column on the display region 10 side are in the opposite directions on the boundary between the display region 10 and the dummy pixel region 30 as well as the sign of the picture signal applied to the pixel electrode 103 of the pixel column on the display region 10 side is opposite to the sign of the picture signal applied to the pixel electrode 103 of the pixel column on the dummy pixel region 30 side, so that the effect of canceling the orientation of a flow of ions on the display region 10 and the orientation of a flow of ions on the dummy pixel region 30 can be made greater. Thus, it is possible to more effectively suppress the production of dark unevenness on the peripheral portion of the display region 10.

On the dummy pixel region 30, the absolute value of the picture signal applied to the pixel column adjacent to the display region 10 may be the same as or greater than the absolute value of the picture signal applied to the pixel column on the end portion of the display region 10. This is because since the area is smaller in the dummy pixel region 30 than in the display region 10, the application of a greater voltage on the dummy pixel region 30 can more effectively cancel the motion of ions migrating from the display region 10.

As described above, the description is made as the embodiment is applied to the case of the pixel array according to the first embodiment. However, the content of the embodiment can be similarly applied to the case of the pixel array according to the second embodiment.

It may be fine that a voltage applied to the dummy pixel is generated in a drive circuit, or it may be fine that a voltage applied to the pixel on the display region is applied through an interconnection. Moreover, it may be fine that in the case where a voltage is generated in the drive circuit, such a configuration is provided in which a voltage close to the maximum gray scale is applied all the time. Furthermore, it may be fine that even in the case where the polarity of the gray scale voltage applied to the pixel electrode on the display region is different for the individual adjacent pixels in the direction of the scanning line or in the direction of the picture signal line, such a configuration is provided in which on the dummy pixel region, a voltage of the same polarity is applied to a plurality of the dummy pixels adjacent in the direction of the scanning line or in the direction of the picture signal line.

Fourth Embodiment

In the embodiments described above, the case of the configuration is described in which the pixel electrode 103 having a comb tooth electrode is disposed on the common electrode 101 in a flat surface through the interlayer insulating film 102. IPS mode liquid crystal display devices also include the case of the configuration in which a common electrode 101 having a slit is disposed on the pixel electrode 103 in a flat surface through the interlayer insulating film 102 in addition to this case. The present disclosure is also applicable to an IPS mode liquid crystal display device having this configuration.

Figure 15:
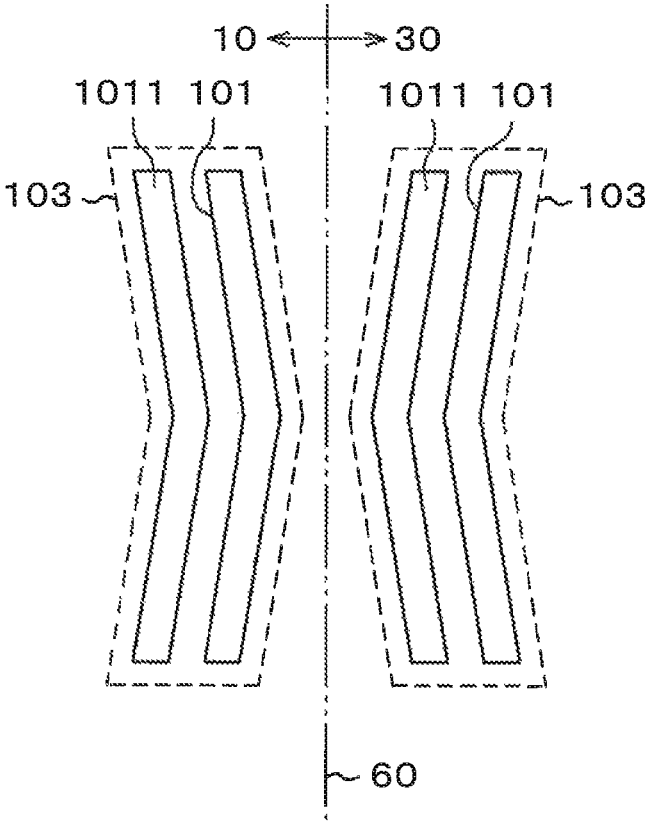
FIG. 15 is a schematic plane view of a pixel portion according to a fourth embodiment.

FIG. 15 is a schematic plane view in the case where the common electrode 101 is disposed on the pixel electrode 103. Since the pixel electrode 103 exists on the under layer of the common electrode 101, the pixel electrode 103 is depicted by a dotted line. In FIG. 15, a scanning line, a picture signal line, a TFT, and the like are omitted, and only the pixel electrode 103 and the common electrode 101 are depicted. In FIG. 15, the pixel electrode 103 is in a bent rectangle as depicted by a dotted line. Although the common electrode 101 is formed above the pixel electrode 103 through the interlayer insulating film, the common electrode 101 in this case is formed as shared by different pixels. This is because a common voltage is applied to the common electrode 101 in the pixels.

However, the common electrode 101 has a slit 1011 at a position opposite to the pixel electrode 103 for the individual pixels, and an electric line of force is extended from the common electrode 101 through this slit 1011 to the pixel electrode 103 through the liquid crystal. This electric field drives the liquid crystal. In other words, in FIG. 15, it can be said that the common electrode 101 is formed throughout the surface in FIG. 15, and the portion without the common electrode 101 is only the portion of the slit 1011. The slit 1011 is bent on the display region as well as on the dummy pixel region for uniformizing the viewing angle characteristics.

In FIG. 15, a two-dot chain line 60 depicts the boundary between the display region 10 and the dummy pixel region 30. The slit 1011 of the common electrode 101 on the display region 10 is bent in a projection in the right direction in FIG. 15. In contrast to this, the bending direction of the slit 1011 of the common electrode 101 on the dummy pixel region 30 is the left side in FIG. 15. The slit 1011 of the common electrode 101 is formed in the shapes as in FIG. 15 on the display region 10 and on the dummy pixel region 30, and a flow of ions in the liquid crystal is in the opposite directions between the display region 10 and the dummy pixel region 30, so that it is possible to prevent the accumulation of ions on the peripheral portion of the display region 10, similarly to the description in the first embodiment.

Figure 16:
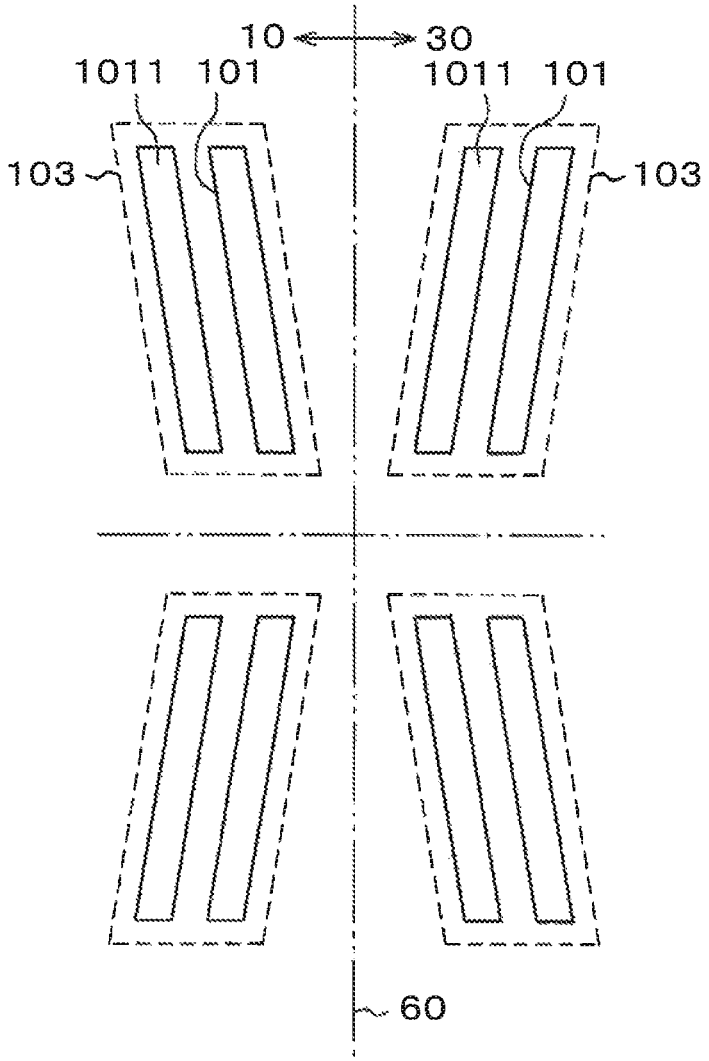
FIG. 16 is a schematic plane view of a pixel portion in another form according to the fourth embodiment.
Figure 17:
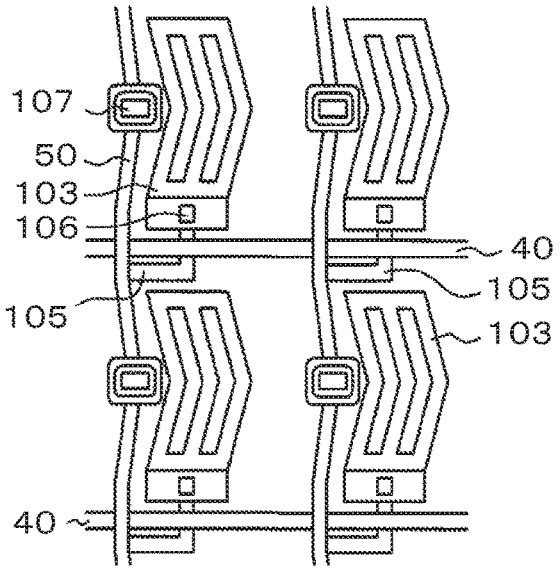
FIG. 17 is a plan view of the shape of a pixel electrode according to a previously existing example.
Figure 18:
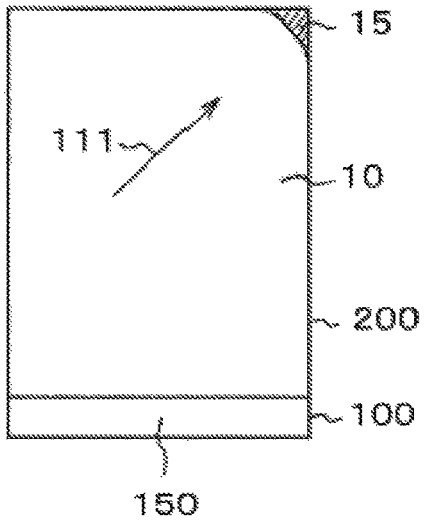
FIG. 18 is a plan view of a liquid crystal display device depicting a problem in a previously existing example.
Figure 19:
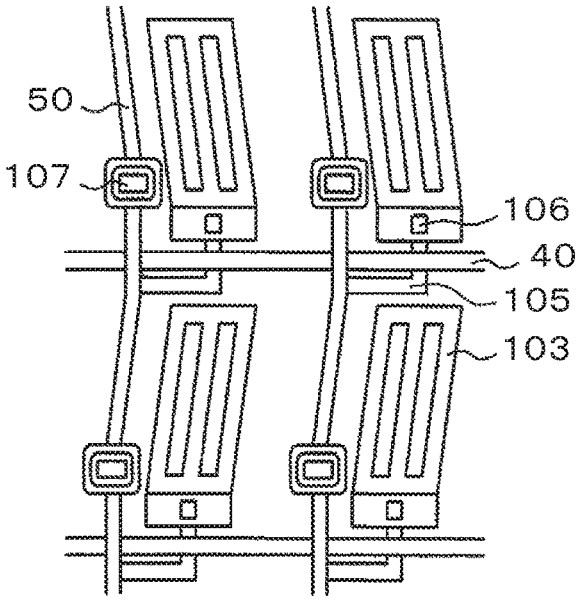
FIG. 19 is a plan view of another shape of a pixel electrode according to a previously existing example.
Figure 20:
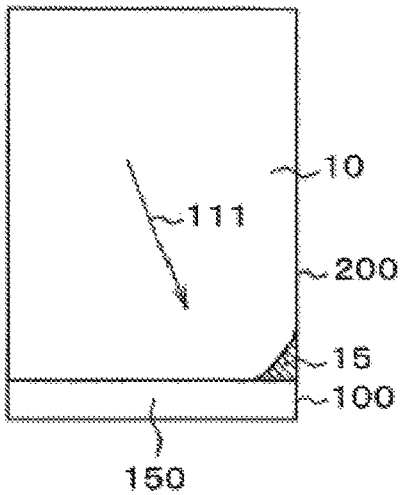
FIG. 20 is a plan view of a liquid crystal display device depicting a problem in the pixel electrode in FIG. 19.
Figure 21:
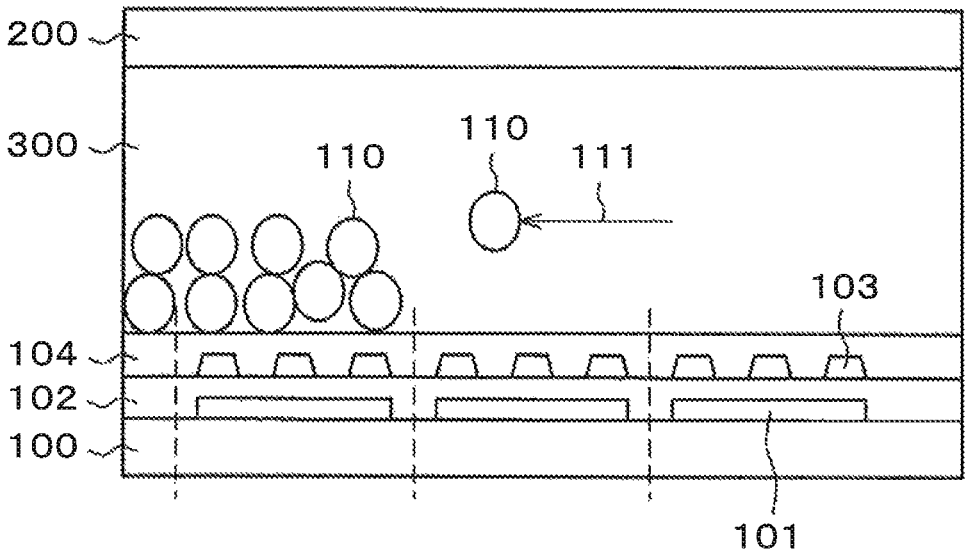
FIG. 21 is a cross sectional view of a liquid crystal display device for describing a problem in a previously existing example.

FIG. 16 is a schematic plane view of an example of the pixel electrode 103 and the common electrode 101 in the case where the common electrode 101 is disposed above the pixel electrode 103 in the pseudo dual domain mode corresponding to the second embodiment. In FIG. 16, a scanning line, a picture signal line, a TFT, and the like are omitted, and only the pixel electrode and the common electrode are depicted. In FIG. 16, the pixel electrode 103 is in a parallelogram as depicted by a dotted line. The common electrode 101 is formed above the pixel electrode 103 through the interlayer insulating film. The common electrode 101 in this case is formed in common in different pixels. This is because a common voltage is applied to the common electrode 101 in the pixels.

However, the common electrode 101 has a slit 1011 at a position opposite to the pixel electrode 103 for the individual pixels, and an electric line of force is extended from the common electrode 101 through this slit 1011 to the pixel electrode 103 through the liquid crystal. This electric field drives the liquid crystal. In FIG. 16, the slope of the slit 1011 of the common electrode 101 is in the opposite directions in the pixels adjacent in the vertical direction in FIG. 16. This is because the mode is the pseudo dual domain mode in which the viewing angle characteristics are uniformized using a pair of two pixels.

In FIG. 16, a two-dot chain line depicts the boundary of the pixels. A two-dot chain line 60 extended in the vertical direction is the boundary between the display region 10 and the dummy pixel region 30. In FIG. 16, the slope of the slit 1011 of the common electrode 101 on the display region 10 and the slope of the slit 1011 of the dummy pixel region 30 are in the opposite directions. Thus, a flow of ions on the display region 10 and a flow of ions on the dummy pixel region 30 are in the opposite directions, so that it is possible to prevent the accumulation of ions on the peripheral portion of the display region.

Also in the case of the configurations of the pixels illustrated in FIGS. 15 and 16, it is possible to further suppress a phenomenon that ions are accumulated on the peripheral portion of the display region by a scheme in which the polarity of the picture signal applied to the pixel column on the end portion of the display region 10 is opposite to the polarity of the picture signal applied to the pixel column on the dummy pixel region 30 adjacent to the display region 10 in the extending direction of the scanning line, similarly to the description in the third embodiment. Moreover, the absolute value of the picture signal applied to the pixel column on the dummy pixel region 30 adjacent to the display region 10 is greater than the absolute value of the picture signal applied to the pixel column on the end portion of the display region 10, so that it is possible to further suppress the phenomenon of ion accumulation.

In the description above, the pixel electrodes 103 according to the first and the second embodiments are in a comb teeth shape, and the pixel electrode 103 has three comb teeth in FIGS. 4 to 12. However, when the pixel is adapted to high definition, the width of the pixel is decreased, and the pixel electrode 103 sometimes has one comb tooth. Even in this case, the configurations described in the first and the second embodiments are applicable to one comb tooth. Moreover, in FIGS. 15 and 16 in the fourth embodiment, two slits 1011 are provided on the common electrode 101. Also in this case, the screen is adapted to high definition, and in some cases, only one slit 1011 is provided on the common electrode 101 in a single pixel. Also in this case, the configurations of the present disclosure described in the fourth embodiment is applicable.

It is noted that it may be fine that such a configuration is provided in which in any of the embodiments, in the case where a plurality of rows or a plurality of columns of the dummy pixels is provided, the bending direction of one or a plurality of the dummy pixels on the near side of the display region is the same bending direction on the display region and an aspect of the invention of the present application is applied to the dummy pixels on the outer side.

Moreover, the pixel electrode or the common electrode in a single pixel includes a plurality of the comb tooth electrodes. However, it may be fine that one comb tooth is provided on the electrodes. Furthermore, an aspect of the invention of the present application is also applicable to such a liquid crystal display device in which the common electrode is provided on the counter substrate and the liquid crystal is driven using an electric field in the oblique direction produced across the pixel electrode and the common electrode.

Heretofore, a rubbing method is used for the alignment process of the alignment film. In the IPS mode liquid crystal display device, the pretilt angle of the liquid crystal molecules is unnecessary, so that photo-alignment can be used in which the alignment process of the alignment film is performed with polarized ultraviolet rays. The present disclosure is also applicable to the cases of using any processes including a rubbing alignment process and a photo-alignment process.

What is claimed is:

1. A liquid crystal display device comprising:

a TFT substrate including a scanning line extended in a first direction, a signal line extended in a second direction;

a counter substrate;

a liquid crystal sandwiched between the TFT substrate and the counter substrate;

a pixel electrode and a common electrode formed between the TFT substrate and the liquid crystal; and an interlayer insulating film disposed between the pixel electrode and the common electrode, wherein the TFT substrate includes a display region and a dummy pixel region;

wherein a pixel on the display region includes a linear shape display pixel electrode which is bent in a projection in the first direction; and wherein a pixel on the dummy pixel region includes a linear shape dummy electrode which is bent in a projection in a direction opposite to the first direction at an angle of 180 degrees.

2. The liquid crystal display device according to claim 1, wherein the dummy pixel region is adjacent to the display region in the first direction and in a direction opposite to the first direction at an angle of 180 degrees.

3. The liquid crystal display device according to claim 1, wherein the dummy pixel region is adjacent to the display region in the second direction and in a direction opposite to the second direction at an angle of 180 degrees.

4. The liquid crystal display device according to claim 1, wherein: a TFT connected to the linear shape display pixel electrode is disposed in the second direction with respect to the linear shape display pixel electrode, and a TFT connected to the linear shape dummy electrode is disposed in a direction opposite to the second direction at an angle of 180 degrees with respect to the linear shape dummy electrode.

5. The liquid crystal display device according to claim 1, wherein the linear shape display pixel electrode is in a comb tooth shape, and the linear shape dummy electrode is in a comb tooth shape.

6. The liquid crystal display device according to claim 1, wherein a polarity of a picture signal applied to a pixel column on the display region adjacent to the dummy pixel region is opposite to a polarity of a picture signal applied to a pixel column on the dummy pixel region adjacent to the display region.

7. The liquid crystal display device according to claim 5, wherein an absolute value of the picture signal applied to the pixel column on the dummy pixel region adjacent to the display region is the same as or greater than an absolute value of the picture signal applied to the pixel column on the display region adjacent to the dummy pixel region.

8. A liquid crystal display device comprising:

a TFT substrate including a scanning line extended in a first direction and arrayed in a second direction at a right angle to the first direction, a picture signal line extended in the second direction and arrayed in the first direction, and a pixel formed between the scanning line and the picture signal line;

a counter substrate; and a liquid crystal sandwiched between the TFT substrate and the counter substrate, wherein: the pixel is formed with a comb tooth pixel electrode on a common electrode formed in a flat surface through an interlayer insulating film;

a display region and a dummy pixel region surrounding the display region are formed on the TFT substrate;

a first display region pixel having a first comb tooth pixel electrode and a second display region pixel having a second comb tooth pixel electrode are formed in the second direction in a pair on the display region;

a first dummy pixel region pixel having a third comb tooth pixel electrode and a second dummy pixel region pixel having a fourth comb tooth pixel electrode are formed in the second direction in a pair on the dummy pixel region;

the first display region pixel and the first dummy pixel region pixel are disposed adjacent to each other in the first direction;

the second display region pixel and the second dummy pixel region pixel are disposed adjacent to each other in the first direction;

a long axis direction of the first comb tooth pixel electrode intersects with a long axis direction of the second comb tooth pixel electrode at an angle in a projection in the first direction, and a long axis direction of the third comb tooth pixel electrode intersects with a long axis direction of the fourth comb tooth pixel electrode at an angle in a projection direction opposite to the first direction at an angle of 180 degrees.

9. The liquid crystal display device according to claim 8, wherein on the display region, a TFT connected to the first pixel electrode is disposed in the second direction with respect to the first pixel electrode, and a TFT connected to the second pixel electrode is disposed in the second direction with respect to the second pixel electrode, and on the dummy pixel region, a TFT connected to the third pixel electrode is disposed in a direction opposite to the second direction at an angle of 180 degrees with respect to the third pixel electrode, and a TFT connected to the fourth pixel electrode is disposed in a direction opposite to the second direction at an angle of 180 degrees with respect to the fourth pixel electrode.

10. The liquid crystal display device according to claim 8, wherein one comb tooth is provided on the first comb tooth pixel electrode, the second comb tooth pixel electrode, the third comb tooth pixel electrode, and the fourth comb tooth pixel electrode.

11. The liquid crystal display device according to claim 8, wherein a polarity of a picture signal applied to a pixel column on the display region adjacent to the dummy pixel region is opposite to a polarity of a picture signal applied to a pixel column on the dummy pixel region adjacent to the display region.

12. The liquid crystal display device according to claim 11, wherein an absolute value of the picture signal applied to the pixel column on the dummy pixel region adjacent to the display region is the same as or greater than an absolute value of the picture signal applied to the pixel column on the display region adjacent to the dummy pixel region.

13. A liquid crystal display device comprising:

a TFT substrate including a scanning line extended in a first direction and arrayed in a second direction at a right angle to the first direction, a picture signal line extended in the second direction and arrayed in the first direction, and a pixel formed between the scanning line and the picture signal line;

a counter substrate; and a liquid crystal sandwiched between the TFT substrate and the counter substrate, wherein: the pixel is formed with a common electrode on a pixel electrode formed in a flat surface through an interlayer insulating film;

a display region and a dummy pixel region surrounding the display region are formed on the TFT substrate;

in a pixel on the display region, a display region slit is formed on the common electrode;

the display region slit is bent in a projection in the first direction;

in a pixel on the dummy pixel region, a dummy pixel region slit is formed on the common electrode, and the dummy pixel region slit is bent in a projection in a direction opposite to the first direction at an angle of 180 degrees.

14. The liquid crystal display device according to claim 13, wherein a TFT connected to the pixel electrode on the display region is disposed in the second direction with respect to the pixel electrode on the display region, and a TFT connected to the pixel on the dummy pixel region electrode is disposed in a direction opposite to the second direction at an angle of 180 degrees with respect to the pixel electrode on the dummy pixel region.

15. The liquid crystal display device according to claim 13, wherein one slit is provided on the display region slit of the pixel on the display region, and one slit is provided on the dummy pixel region slit of the dummy pixel region.

16. The liquid crystal display device according to claim 13, wherein a polarity of a picture signal applied to a pixel column on the display region adjacent to the dummy pixel region is opposite to a polarity of a picture signal applied to a pixel column on the dummy pixel region adjacent to the display region.

17. The liquid crystal display device according to claim 16, wherein an absolute value of the picture signal applied to the pixel column on the dummy pixel region adjacent to the display region is the same as or greater than an absolute value of the picture signal applied to the pixel column on the display region adjacent to the dummy pixel region.

* * * * *